US006995503B2

(12) United States Patent
Hatta et al.

(10) Patent No.: US 6,995,503 B2
(45) Date of Patent: Feb. 7, 2006

(54) CATHODE RAY TUBE TENSION MASK MADE OF MAGNETOSTRICTIVE MATERIAL WITH COMPENSATION FOR TERRESTRIAL MAGNETISM

(75) Inventors: Shin-ichiro Hatta, Nara (JP); Ryuichi Murai, Toyonaka (JP); Hiroshi Iwamoto, Toyonaka (JP); Shigeo Nakatera, Hirakata (JP); Tetsuro Ozawa, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/130,922

(22) PCT Filed: Aug. 10, 2001

(86) PCT No.: PCT/JP01/06892

§ 371 (c)(1),
(2), (4) Date: Aug. 29, 2002

(87) PCT Pub. No.: WO02/29847

PCT Pub. Date: Apr. 11, 2002

(65) Prior Publication Data

US 2003/0127963 A1 Jul. 10, 2003

(30) Foreign Application Priority Data

Sep. 29, 2000 (JP) ..... 2000-299773

(51) Int. Cl.
*H01J 29/80* (2006.01)

(52) U.S. Cl. ..... 313/402; 313/408; 445/36

(58) Field of Classification Search ..... 313/402–408; 445/36, 37, 47
See application file for complete search history.

(56) References Cited

U.S. PATENT DOCUMENTS

| | | | | |
|---|---|---|---|---|
| 5,396,146 | A * | 3/1995 | Nakamura et al. | 313/402 |
| 5,523,647 | A * | 6/1996 | Kawamura et al. | 313/407 |
| 5,742,116 | A * | 4/1998 | Maki et al. | 313/402 |
| 6,229,255 | B1 * | 5/2001 | Kim et al. | 313/402 |
| 6,316,869 | B1 * | 11/2001 | Kim et al. | 313/402 |
| 6,372,058 | B1 * | 4/2002 | Ono | 148/336 |
| 6,559,583 | B1 * | 5/2003 | Kanayama et al. | 313/402 |

FOREIGN PATENT DOCUMENTS

| | | |
|---|---|---|
| JP | 10-25517 | 1/1998 |
| JP | 2000-96189 | 4/2000 |
| JP | 2001-250489 | 9/2001 |

* cited by examiner

*Primary Examiner*—Mariceli Santiago
*Assistant Examiner*—Anthony Perry
(74) *Attorney, Agent, or Firm*—Hamre, Schumann, Mueller & Larson, P.C.

(57) ABSTRACT

A cathode ray tube is provided, in which the flatness of a tension mask constituting a color-selection mechanism is maintained by a suitable stretching force, while with the tension mask, the influence of external magnetic fields, such as the terrestrial magnetism is suppressed, and the shifting of the electron beam is reduced. A tension mask made of a magnetostrictive material is used, the tension mask is stretched by a stretching force in a range maintaining the flatness of the tension mask, and the direction and strength of the stretching force are set such that vertical magnetic permeability of the tension mask increases, due to a magnetoelastic effect caused by the stretching force in the magnetostrictive material of the tension mask.

3 Claims, 6 Drawing Sheets

CATHODE RAY TUBE TENSION MASK MADE OF MAGNETOSTRICTIVE MATERIAL WITH COMPENSATION FOR TERRESTRIAL MAGNETISM

TECHNICAL FIELD

The present invention relates to a cathode ray tube, in which electron beam shifts caused by external magnetic fields, such as the terrestrial magnetism, are reduced by means of a tension mask, such as a shadow mask that constitutes a color selection mechanism and is stretched with a predetermined tensile force.

BACKGROUND ART

When placed in the terrestrial magnetic field, the electron beams emitted by the electron gun in a cathode ray tube are subject to an excess Lorentz force due to the terrestrial magnetic field. Thus, the movement of the electrons shifts several dozen $\mu$m away from the regular trajectory, so that it does not hit the fluorescent material on the screen properly, and so-called "mislanding" occurs. Such electron beam shifts cause color deviations and color irregularities on the screen.

In cathode ray tubes for flat TVs, which are becoming the mainstream in recent years, the shadow mask sheet is often stretched under the application of tensile forces to increase the flatness of the screen. But when the shadow mask is stretched with high tensile forces, the electron beam shifts increase, and color deviations and color irregularities become even worse. Thus, there is a demand for a way to effectively correct for the terrestrial magnetism in cathode ray tubes for flat TVs.

DISCLOSURE OF THE INVENTION

It is an object of the present invention to provide a cathode ray tube, in which electron beam shifts have been reduced. The flatness of a tension mask constituting a color selection mechanism such as a shadow mask, is maintained by a suitable stretching force. It should be noted that in accordance with the present invention, "tension mask" means all masks used as a color-selection mechanism, such as shadow masks with holes, slot-type shadow masks, or slit-shaped aperture grilles.

In a cathode ray tube in the basic configuration of the present invention, a tension mask made of a magnetostrictive material is used, the tension mask is stretched by a stretching force in a range maintaining the flatness of the tension mask, and the direction and strength of the stretching force are set such that the vertical magnetic permeability of the tension mask increases, due to a magnetoelastic effect caused by the stretching force in the magnetostrictive material of the tension mask.

In this basic configuration, when the magnetostrictive material has a positive magnetostrictive constant, it is preferable that an angle defined by a direction of an easy axis of magnetization in-plane in the tension mask and a direction in which the stretching force is applied to the tension mask is between 30° and 90°. It is also preferable that in the positive magnetostrictive material, the crystal axes of polycrystalline grains are oriented along the easy axis of magnetization. As the sheet of magnetostrictive material, it is possible to use an iron or silicon steel sheet in which the polycrystalline grains are in-plane oriented in the crystal axis (100) direction. For the above-described configuration, it is suitable if, for example, an angle defined by a stretching direction of the tension mask and a rolling direction during the process of manufacturing the sheet of magnetostrictive material is between 30° and 90°.

When the magnetostrictive material in the basic configuration has a negative magnetostrictive constant, it is preferable that an angle defined by a direction of an easy axis of magnetization in-plane in the tension mask and a direction of the stretching force is between 0° and 40°. It is preferable that in the negative magnetostrictive material, the crystal axes of polycrystalline grains are oriented along the easy axis of magnetization. As the sheet of magnetostrictive material, it is possible to use a sheet of an iron nickel alloy with at least 80% nickel content, or at least 30% and at most 50% nickel content in which the polycrystalline grains are in-plane oriented in the crystal axis (100) direction, or an iron or silicon steel sheet in which the polycrystalline grains are in-plane oriented in the crystal axis (111) direction. For the above-described configuration, it is suitable if, for example, an angle defined by a stretching direction of the tension mask and a rolling direction during the process of manufacturing the sheet of magnetostrictive material is between 0° and 40°.

BEST MODE FOR CARRYING OUT THE INVENTION

The following is a description of the preferred embodiments of the present invention, with reference to the accompanying drawings.

Figure 1:
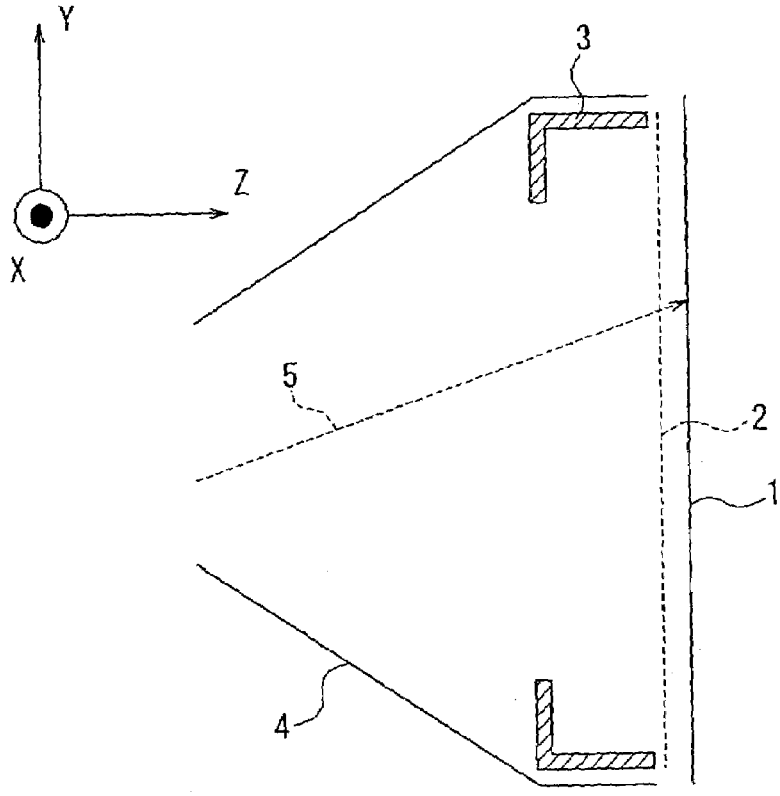
FIG. 1 is a diagrammatic cross-section showing the configuration of the principal parts of a cathode ray tube in an embodiment of the present invention.

FIG. 1 illustrates the configuration of the principal parts of a cathode ray tube and the trajectory of an electron beam that has been emitted by an electron gun. Numeral 1 denotes a screen, and numeral 2 denotes a tension mask 2 that is arranged in close proximity of the inner surface of the screen 1. The tension mask 2 is stretched by a frame 3. An internal magnetic shield 4 is arranged to cover the tension mask 2 and the frame 3. Numeral 5 denotes the trajectory of the electron beam.

Regarding the form of the tension mask 2, the present invention can be applied to all known forms that can be used for a color selection mechanism, although this is not shown in the drawings. That is to say, the tension mask 2 can be a shadow mask with holes, a slot-type shadow mask, or a slit-shaped aperture grille.

In the present invention, the tension mask 2 is made of a magnetostrictive material, in which the relationship between stretching direction and easy axis of magnetization is set appropriately. Thus, due to the magnetoelastic effect arising in the magnetostrictive material of the tension mask 2, the magnetic permeability in vertical direction of the tension mask 2 is increased and the magnetic resistance is decreased, and as a result, shifts of the electron beam 5 can be reduced effectively. This effect is explained in the following.

In the space inside the internal magnetic shield 4, the electron beam 5 experiences the Lorentz force $$f=q(v\times B) \quad \text{(Equation 1)}$$

due to the magnetic field inside, and hits a position that is shifted from the original landing position. In Equation 1, f is the force that is applied to the electron, q (<0) is the charge of one electron, v is the velocity vector of the electron, and B is the magnetic flux density. × is the vector product of the vectors.

Figure 2:
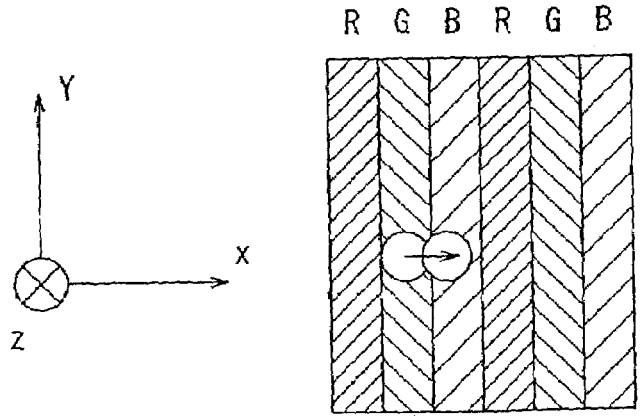
FIG. 2 is a plan view showing the stripe configuration on the fluorescent surface of a cathode ray tube.

FIG. 2 shows the stripe structure of the fluorescent material on the screen 1. Because, as shown in FIG. 2, the fluorescent material extends in the direction of the y axis (vertical direction) on the screen 1, forces responsible for shifts in y-axis direction are not problematic. Also forces in the z-axis direction (perpendicular to the screen) do not have to be considered. What has to be considered is the force leading to shifts in x-direction:

$$f_x=|q|(B_zV_y-B_yV_z) \quad \text{(Equation 2)}$$

In order to reduce the shifting force in the x-direction, the influence of the magnetic flux passing in the vertical direction $B_y$ through the tension mask 2 has to be suppressed.

Figure 3:
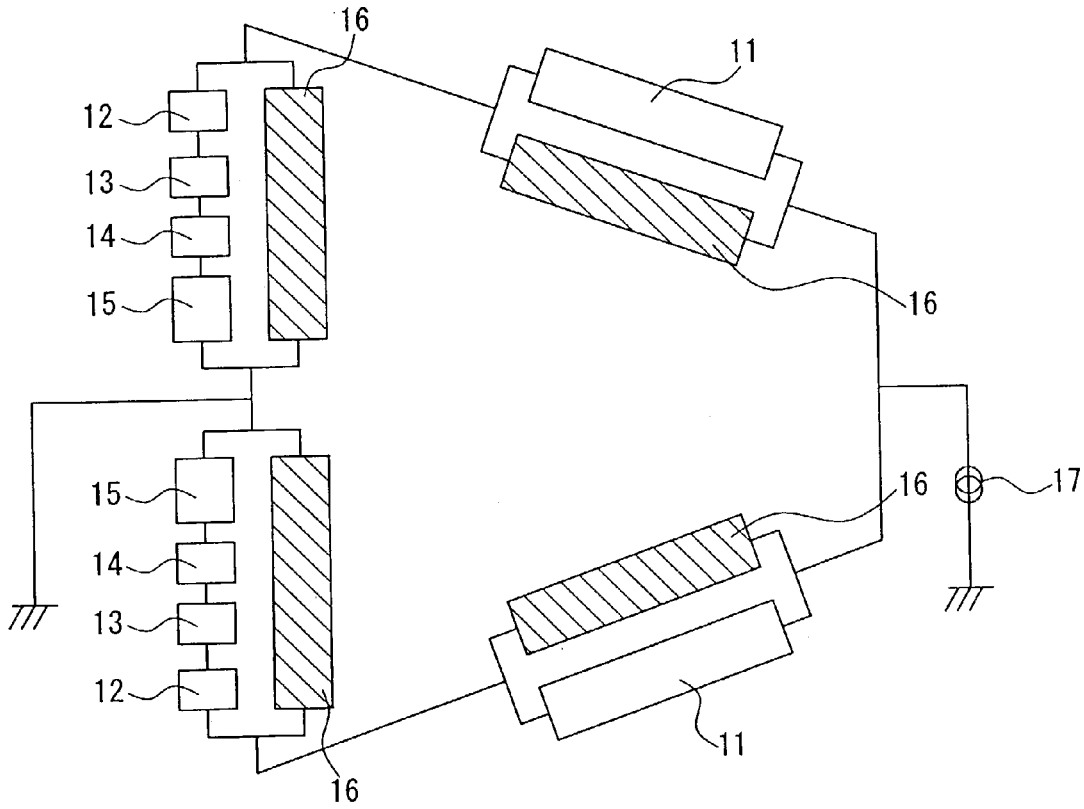
FIG. 3 is a circuit diagram illustrating the flow of the magnetic flux inside the cathode ray tube as an equivalent circuit.

This fact pattern is taken into consideration and further consideration is given to the flow of the magnetic flux. Usually, the tension mask 2 and the frame 3 are made of magnetic material, so that it is convenient to qualitatively analyze their magnetic structure, together with the internal magnetic shield 4, by converting it into an equivalent circuit, determining the magnetic resistances, and regarding the magnetic flux as electric current. Such an equivalent circuit is shown in FIG. 3. Here, the internal magnetic shield 4, the frame 3, and the tension mask 4 are considered as a circuit structure that is vertically symmetrical, and it is assumed that there are magnetic resistances that are connected by the upper and lower circuit lines, respectively. The magnetic resistance of the internal magnetic shield 4 is illustrated as shield magnetic resistances 11. The magnetic resistances related to the frame 3 and the tension mask 4 are shown as frame magnetic resistances 12, welding portion magnetic resistances 13, stretching magnetic resistances 14 and mask magnetic resistances 15. Moreover, vacuum magnetic resistances 16 are disposed in parallel to the various magnetic resistances.

The source of the flow of magnetic flux in these is the terrestrial magnetism, which can be regarded as a virtual current source 17. The current flowing from the current source 17 passes through the shield magnetic resistances 11, the frame magnetic resistances 12, the welding portion magnetic resistances 13, the stretching magnetic resistances 14, the mask magnetic resistances 15, and the vacuum magnetic resistances 16 arranged in parallel thereto, and can be thought finally to flow out from the center of the tension mask 2 to the ground. When actually an external field of 0.35 G was applied from the tube axis direction, and the flow of the magnetic flux was followed with a Gauss meter, it was found that the edge of the aperture portion of the internal magnetic shield 4 serves as an inlet port for the magnetic flux, and the magnetic flux gushes out from the edges of the internal magnetic shield 4 on the side of the tension mask 2, the magnetic flux flows into the tension mask 2, and the direction of the magnetic flux reverses at the center of the tension mask 2.

The magnetic flux flowing from the edges of the internal magnetic shield 4 on the side of the tension mask 2 flows into the tension mask 2, forming a circulating magnetic circuit. If iron is used for the tension mask 2, then, when the stretching force on the tension mask 2 is zero, the mask magnetic resistances 15 become small, and the magnetic flux can flow easily. As a result, the flow of the magnetic flux flowing out from the edges of the internal magnetic shield 4 is sucked up almost completely by the tension mask 2, and almost no magnetic flux leaks to the inner side of the tension mask 2.

However, when, for example, the iron tension mask 2 is stretched and a tension is applied, then the magnetic permeability of the tension mask 2 decreases, and the tension mask 2 cannot be magnetized easily with weak magnetic fields anymore. That is to say, the mask magnetic resistance 15 increases, the flow of the magnetic flux through the stretched tension mask 2 is inhibited, and a large portion of the magnetic flux leaks into the space on the inner side of the tension mask 2. This leakage magnetic flux $B_y$ is in the direction enhancing the beam shifts, so that the beam shifts become larger.

The magnetic resistances of this equivalent circuit are convenient for understanding the phenomena, but actually, they cannot be understood easily. Even when using the widely known value $$Rm=L/(\mu S) \quad \text{(Equation 3)}$$

for the magnetic resistances, the permeability ($\mu$) of the magnetic material is not an intrinsic value of the material, but depends in a complex manner from the position and the strength of the applied magnetic field. In Equation 3, L is the length of the sample, and S is its cross sectional area.

Figure 4:
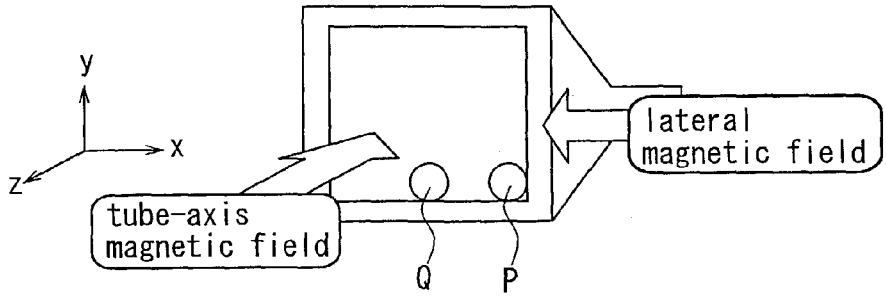
FIG. 4 is a diagram illustrating the measurement points for the electron beam shift on the fluorescent surface of the cathode ray tube.

As a criterion for the correction of the terrestrial magnetism in a cathode ray tube, the shifts of the electron beam measured at the following three types of fixed points were used as examples. The three types of fixed points correspond to, as shown in FIG. 4, the corner evaluation point P, the NS evaluation point Q which is the middle of the long side of the screen, to which different combinations of magnetic fields are applied.

lateral magnetic corner: corner evaluation point P when applying a magnetic field in x, y direction tube axis corner: corner evaluation point P when applying a magnetic field in y, z direction tube axis NS: NS evaluation point Q when applying a magnetic field in y, z direction In the actual experiment, no measurement is performed in the terrestrial magnetic field. For example, after performing demagnetization, for the lateral magnetic corner, the average value of the beam shift at the corner evaluation point P of the screen is determined, applying a static magnetic field of −0.35 Oe in y-direction and 0.35 Oe in x-direction. For the tube axis corner, the average value of the beam shift at the corner evaluation point P of the screen is determined, applying a static magnetic field of −0.35 Oe in y-direction and 0.35 Oe in z-direction. For the tube axis NS, the average value of the beam shift at the evaluation point Q at the center of the long side of the screen is determined, applying a static magnetic field of −0.35 Oe in y-direction and 0.35 Oe in z-direction. For convenience, (shift amount for lateral magnetic corner, shift amount for tube axis corner, shift amount for tube axis NS) is written as, for example, (20 μm, 45 μm, 40 μm)

and this is taken as the criterion of the electron beam shift.

Mounting a regular internal magnetic shield on a frame and a tension mask made of a ferroalloy sheet of about 0.1 mm thickness stretched at 200 N/mm$^2$ in the vertical direction (NS direction) across the screen, and applying an external magnetic field, a beam shift of (20 μm, 45 μm, 40 μm)

was measured at the measurement points. This shift is too large, so when the stretching force of the tension mask was set to zero, and then the beam shifts were measured under exactly the same conditions as when stretching, a beam shift of (20 μm, 25 μm, 23 μm)

was measured, which was a great improvement. But on the other hand, the flatness of the tension mask deteriorated considerably. Thus, there is a need for a method for decreasing the beam shifts while maintaining the flatness of the tension mask by tension.

Figure 5:
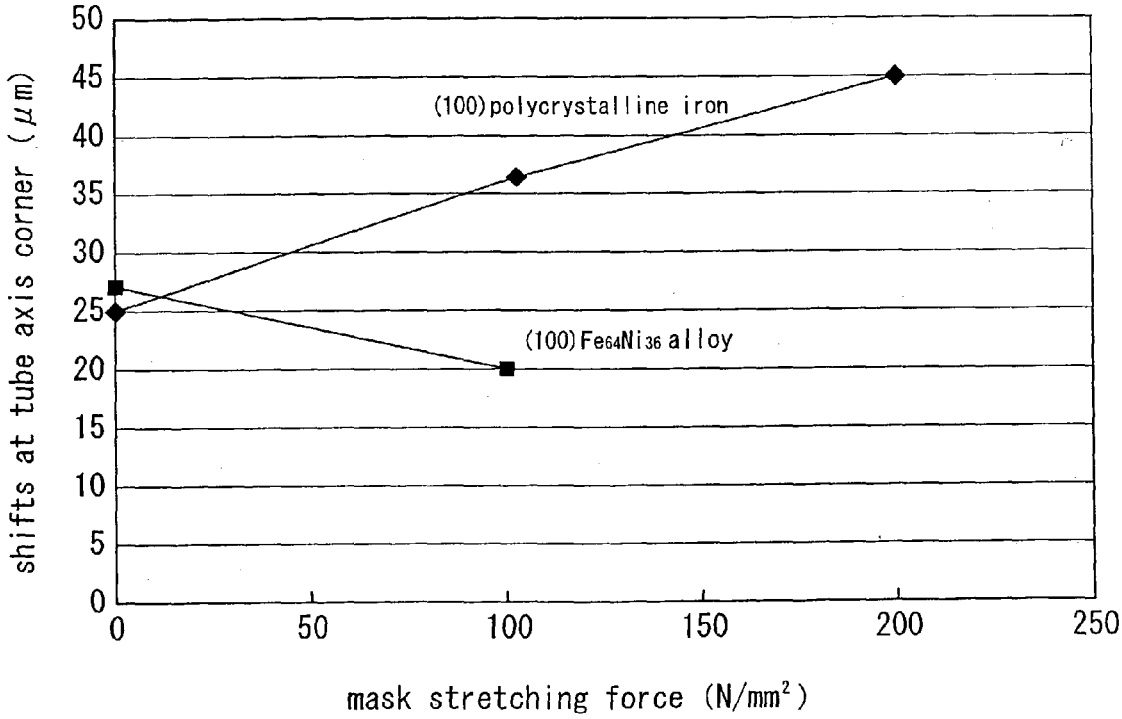
FIG. 5 shows the relationship between the beam shift and the stretching force at the tube axis corner portion when using tension masks of (100) oriented polycrystalline iron and (100) oriented $Fe_{64}Ni_{36}$.

The following is an explanation of the reason why the electron beam shifts are changed by the tension of the tension mask. FIG. 5 illustrates how the beam shifts at the tube axis corner portion change when the stretching force of the tension mask is changed. In FIG. 5, a polycrystalline steel sheet with 0.1 mm thickness that was in-plane oriented in crystal axis (100) direction and stretched in (100) direction, and an $Fe_{64}Ni_{36}$ alloy with 0.1 mm thickness that was in-plane oriented in crystal axis (100) direction and stretched in (100) direction are shown as examples for the tension mask material. In the tension mask material of the polycrystalline iron, the shift amount at the tube axis corner increases considerably when the stretching force increases, whereas in the tension mask of $Fe_{64}Ni_{36}$ alloy, the shift amount decreases. This means that the directions of the beam shifts due to increasing stretching force depend on the tension mask material.

Figure 6A:
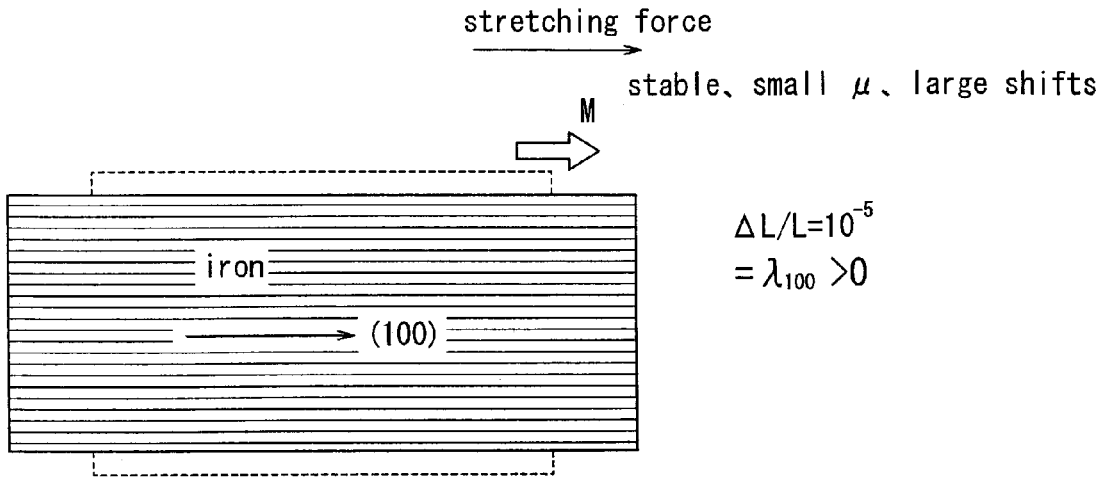
FIG. 6A and FIG. 6B illustrate the relationship between positive and negative electrostrictive material and the stretching direction of the tension mask.

This can be explained as follows by the phenomenon of magnetostriction. When a magnetic material of the length L is magnetized from its demagnetized state in a constant direction until saturation, then usually, its length in the magnetization direction changes slightly by δL. The average magnetostrictive constant λ is defined as the change ratio $$\delta L/L=\lambda \quad \text{(Equation 4)}$$

of the length at this time. The value of λ can be expressed as $$\lambda=0.4\lambda_{100}+0.6\lambda_{111} \quad \text{(Equation 5)}$$

in a cubic non-oriented polycrystal. In Equation 5, $\lambda_{100}$ is the change ratio of the length when magnetized in (100) direction and $\lambda_{111}$ is the change ratio of the length when magnetized in (111) direction. The values of $\lambda_{100}$ and $\lambda_{111}$ for typical magnetic materials are known from the literature, and λ can be determined by calculation. If the orientation ratio of the polycrystal is high with respect to one direction, then the λ can be positive or negative even for the same material. For example, for the iron shown in FIG. 6A, $\lambda_{100}$ is positive, whereas $\lambda_{111}$ is negative. According to Equation 5, polycrystalline iron that is completely non-oriented is more contracted than when it is in a non-magnetic state. Thus, in polycrystalline iron that is oriented in (100) direction, $\lambda_{100}$ is positive, so that it becomes longer in this orientation direction. This orientation direction is the direction of the easy axis of magnetization.

Figure 6B:
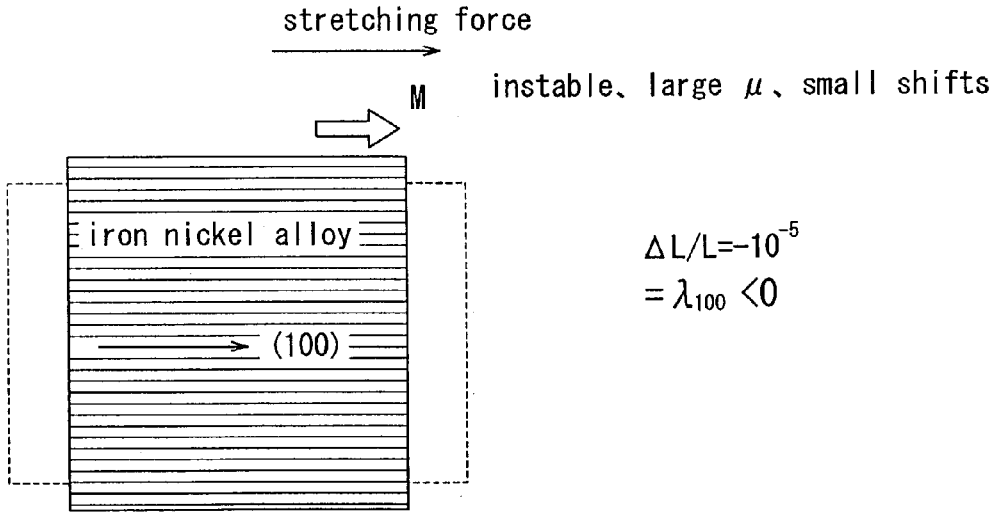

Conversely, as shown in FIG. 6B, in iron nickel alloy (with at least 35% nickel content), which has a face-centered cubic structure, when the nickel content is at least 30% and at most 50%, or at least 80%, then $\lambda_{100}$ is negative. Thus, when the polycrystalline nickel alloy with its face-centered cubic structure is oriented in (100) direction, its $\lambda_{100}$ is negative, so that it contracts in this orientation direction. This orientation direction is often the direction of the easy axis of magnetization.

This means, also for polycrystals, there are magnetic materials that are extended by magnetization as well as materials that are contracted by it. Thus, when a certain material has an average magnetostrictive constant λ that is positive or negative, and when a tensile force σ is applied in a direction that defines an angle φ with the magnetization, then the magnetoelastic energy can be expressed as $$E=-1.5\lambda\sigma\cos^2\phi \quad \text{(Equation 6)}$$

This is one kind of uniaxial anisotropy, and the energy is minimal when φ=0 at λ>0. This means, the magnetization is more stable when it is directed in the direction similar to that of the stretching force. Conversely, when λ<0, then the magnetization is more stable when it is directed in the direction perpendicular to that of the stretching force.

When a magnetic field is applied in the direction of the tensile force, then, at λ>0, the magnetization already directed in the direction of the magnetic field, so that further magnetization is difficult. Consequently, the magnetic permeability μ becomes small. Conversely, at λ<0, the magnetization is directed in a direction perpendicular to the magnetic field, so that the magnetization is easily directed to the direction of the magnetic field. Consequently, the magnetic permeability μ becomes large. The magnetic resistance is inversely proportional to the magnetic permeability μ, as shown by Equation 3, so that when stretched, for λ>0, the magnetic resistance of the tension mask is large, and for λ<0, the magnetic resistance of the tension mask is small. As a result, as shown in FIG. 5, the flow of the magnetic flux into the stretched tension mask is impeded for λ>0, and a larger portion of the magnetic flux leaks into the space at the inner surface tension mask, and the beam shifts are increased. On the other hand, when λ<0, most of the magnetic flux flows through the tension mask, and only little leaks out into the space on the inner surface side, so that as a result, the beam shifts are diminished.

The conclusion of the above is that when using a positive magnetostrictive material for the tension mask, it is preferable that the stretching direction is perpendicular to the magnetostrictive direction, that is, the direction of the easy axis of magnetization. Since the tension mask is stretched applying a large tensile force to it in the vertical direction, it should be disposed so that the easy axis of magnetization is arranged in lateral direction.

As one example of the magnetostrictive material, oriented polycrystalline iron is explained in the following. Thin sheets of iron usually are formed by rolling out steel. In this situation, a lot of polycrystalline grains are oriented in-plane with the (100) direction oriented in the rolling direction. Thus, this rolled iron sheet is extended in the (100) direction, that is, the rolling direction, due to magnetostriction. When it is stretched at a force of 200 N/mm$^2$ in the magnetostrictive direction, the magnetic resistance of the tension mask increases and the beam shifts at the tube axis corner become 40 $\mu$m or larger. On the other hand, when it is stretched in a direction perpendicular to the rolling direction, that is (100) direction, the beam shifts are reduced to about 30 $\mu$m.

Figure 7:
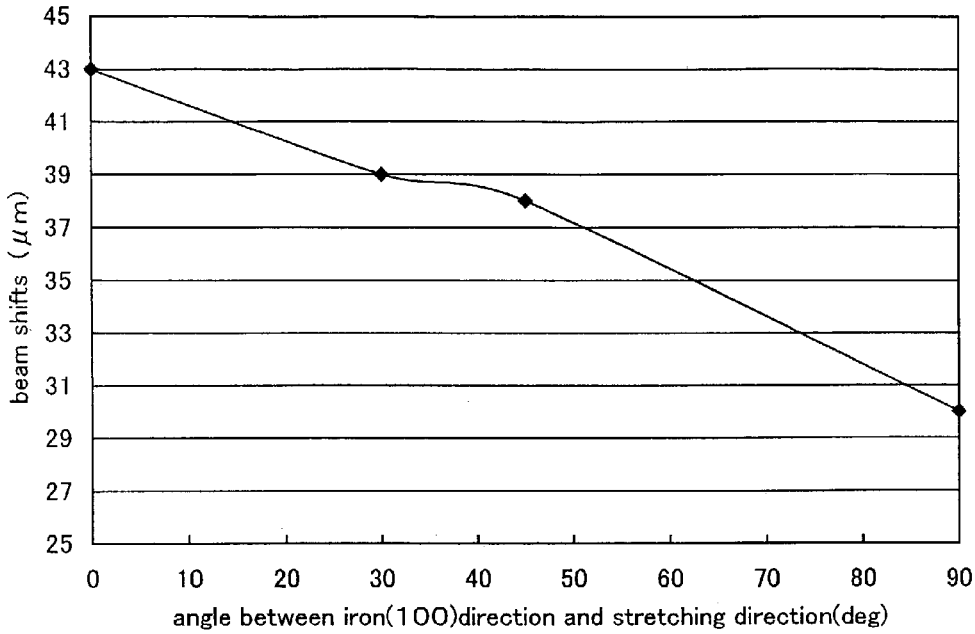
FIG. 7 illustrates the relationship between the beam shift amount at the tube axis corner portion and the angle defined by the stretching direction of the tension mask and the (100) orientation direction of the polycrystalline iron.
Figure 8:
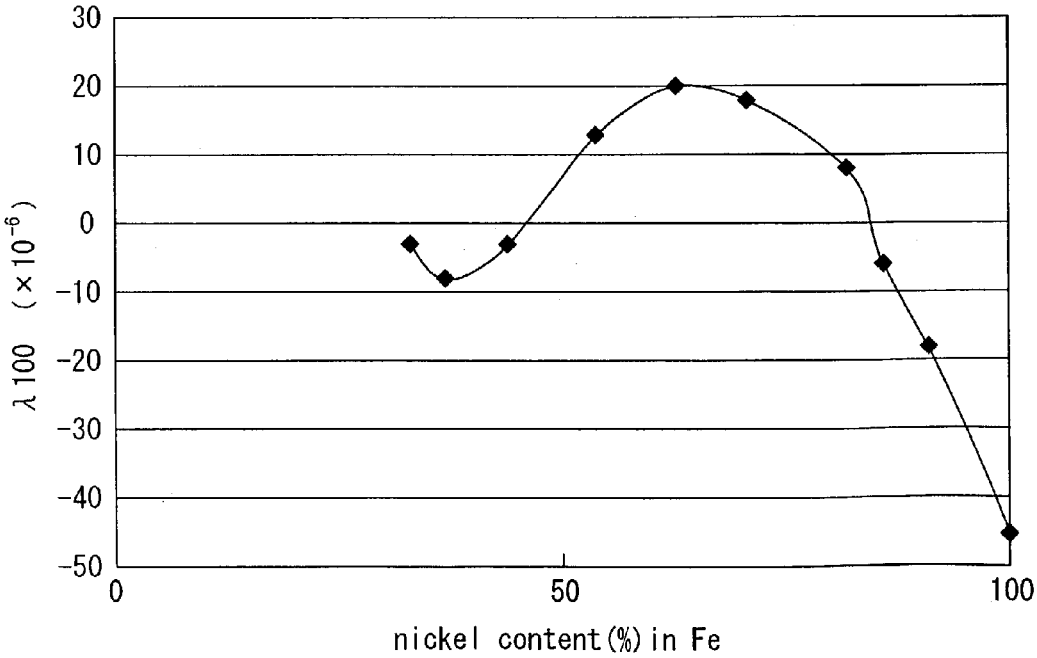
FIG. 8 illustrates the relationship between the magnetostrictive constant $\lambda$ and the iron content of an iron nickel alloy.

As shown in FIG. 7, a similar effect can also be attained when the stretching direction deviates from the perpendicular direction, and the angle between the (100) direction and the stretching direction was between 30° and 90°. The horizontal axis in FIG. 7 marks the angle defined by the stretching direction of the tension mask and the (100) orientation direction of the polycrystalline iron. The vertical axis marks the beam shift at the tube axis corner portion. This angle is preferably between 55° and 90°, and more preferably between 70° and 90°.

Moreover, a similar effect was attained when the stretching force was between 100 N/mm$^2$ and 300 N/mm$^2$. A similar effect was also observed for body-centered cubic iron alloys into which trace amounts of other elements (Cr, Mo, etc.) were mixed.

Moreover, a similar effect was also observed for silicon steel sheets containing not more than 8% silicon.

If a negative magnetostrictive material is used for the stretched tension mask, then it is preferable that the stretching direction is the same direction as the magnetostrictive direction, that is, the direction of the easy axis of magnetization. Since the tension mask is stretched applying a large tensile force to it in the vertical direction, it should be disposed so that the easy axis of magnetization is arranged in vertical direction.

As one example of the magnetostrictive material, oriented iron nickel alloy is explained in the following. When using as the tension mask material nickel with the crystal axes oriented in-plane in the (100) direction, or an iron nickel alloy with a 36% concentration of nickel, the beam shifts decreased at a stretching force of 30 N/mm$^2$ or higher. The value of $\lambda$ of these materials is negative and on the order of $-10^{-5}$ (see FIG. 7). To make thin sheets of iron nickel alloy, the raw material is rolled. In this situation, a lot of polycrystalline grains are oriented in-plane with the (100) direction oriented in the rolling direction. Thus, this rolled alloy sheet is constricted in the (100) direction, that is, the rolling direction, due to magnetostriction. When the rolled alloy sheet is used as the tension mask and stretched at a force of at least 30 N/mm$^2$ in the magnetostrictive direction, the magnetic resistance of the tension mask decreases and the beam shifts at the tube axis corner become 30 $\mu$m or less.

Figure 9:
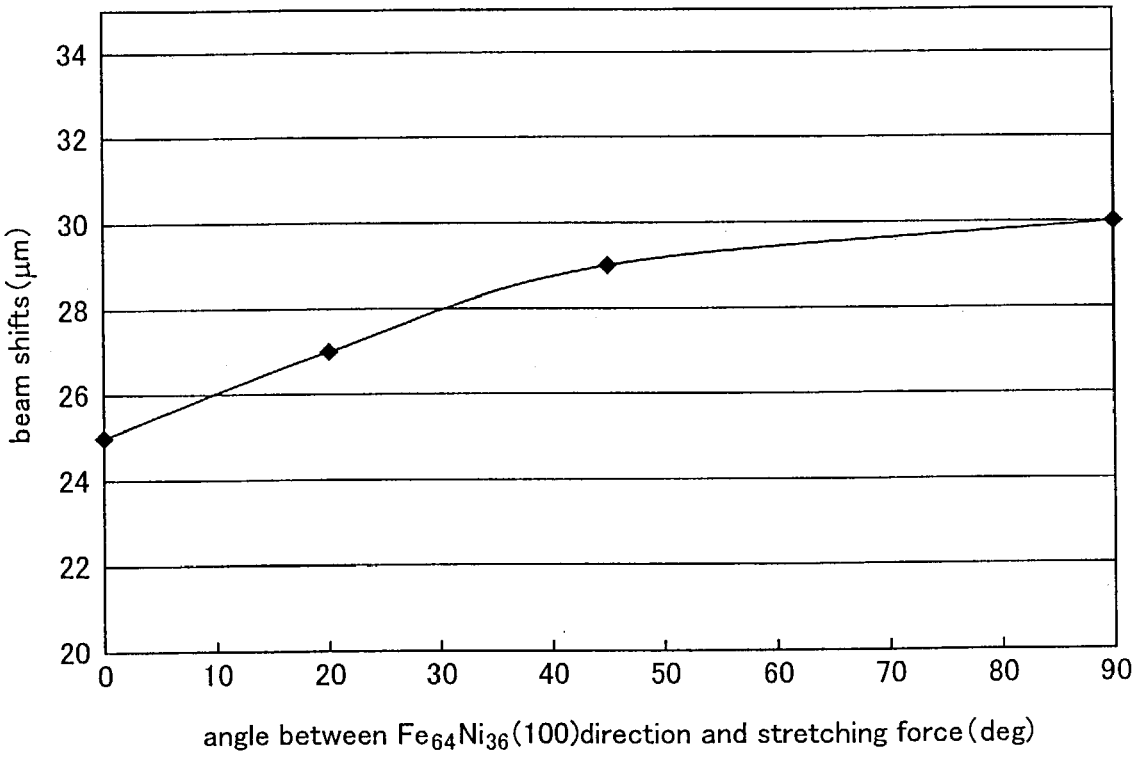
FIG. 9 illustrates the relationship between the beam shift amount at the tube axis corner portion and the angle defined by the stretching direction of the tension mask and the (100) orientation direction of $Fe_{64}Ni_{36}$ alloy.

As shown in FIG. 9, a similar effect also was attained when the stretching direction deviates from the rolling direction, and the angle between the (100) direction and the stretching direction was between 0° and 40°. The horizontal axis in FIG. 9 marks the angle defined by the stretching direction of the tension mask and the (100) orientation direction of the $Fe_{64}Ni_{36}$. The vertical axis marks the beam shift at the tube axis corner portion. This angle is preferably between 0° and 25°, and more preferably between 0° and 10°.

Moreover, a similar effect was attained when the stretching force was between 20 N/mm$^2$ and 200 N/mm$^2$. Incidentally, when using $Fe_{64}Ni_{36}$ alloy at a stretching force of 100 N/mm$^2$, the shift amount in the tube axis corner portion decreased further from 30 $\mu$m to 25 $\mu$m, compared to a stretching force of zero. Such an effect also was attained in a sufficient range for practice, when using, as the material for the tension mask, iron nickel alloys with a nickel component of at least 80%, or iron nickel alloys with a nickel component of at least 30% and at most 50%. Theoretically, a similar effect can also be attained with iron or silicon steel sheets with polycrystalline orientation in the crystal axis (111) direction.

In the foregoing explanations, magnetostrictive materials in which the crystal axes of the polycrystal grains were oriented along the easy axis of magnetization were taken as examples, but a practical effect also can be attained with materials that do not fulfill these conditions. However, a reliable effect is generally easier to obtain with magnetostrictive materials in which the crystal axes of the polycrystal grains were oriented along the easy axis of magnetization.

INDUSTRIAL APPLICABILITY

In accordance with the present invention, a cathode ray tube is realized, in which the tension mask is made of a magnetostrictive material, and the flatness of the tension mask is maintained by a suitable stretching force, while the shifting of the electron beam is reduced. Thus, the influence of external magnetic fields, such as the terrestrial magnetism, can be suppressed to a level that poses no problems in practice.

What is claimed is:

1. A cathode ray tube comprising a tension mask made of a magnetostrictive material, wherein the magnetostrictive material has a positive magnetostrictive constant, the tension mask is stretched by a stretching force in a vertical direction so as to maintain the flatness of the tension mask with an angle defined by a direction of an easy axis of magnetization in-plane in the tension mask and a direction in which the stretching force is applied to the tension mask is being between 30° and 90°, and the combination of the direction and strength of the stretching force are set such that vertical magnetic permeability of the tension mask increases, due to a magnetoelastic effect caused by the stretching force in the magnetostrictive material of the tension mask, wherein the magnetostrictive material includes a plurality of polycrystalline grains, each having an axis oriented along the easy axis of magnetization.

2. The cathode ray tube according to claim 1, wherein the sheet of magnetostrictive material is an iron or silicon steel sheet in which the polycrystalline grains are in-plane oriented in crystal axis (100) direction.

3. The cathode ray tube according to claim 1, wherein an angle defined by a stretching direction of the tension mask and a rolling direction during the process of manufacturing a sheet of magnetostrictive material is between 30° and 90°.

* * * * *

UNITED STATES PATENT AND TRADEMARK OFFICE

CERTIFICATE OF CORRECTION

PATENT NO. : 6,995,503 B2
APPLICATION NO. : 10/130922
DATED : February 7, 2006
INVENTOR(S) : Hatta et al.

It is certified that error appears in the above-identified patent and that said Letters Patent is hereby corrected as shown below:

Col. 8, line 46: “mask is being” should read --mask being--

Signed and Sealed this

Seventh Day of November, 2006

JON W. DUDAS
*Director of the United States Patent and Trademark Office*